US005481974A

United States Patent [19]

Sarazen et al.

[11] Patent Number: 5,481,974

[45] Date of Patent: Jan. 9, 1996

[54] INSERT FOR INK FOUNTAINS FOR PRINTING MACHINES

[75] Inventors: David Sarazen, Stonington, Conn.; Josef Plantsch, Augsburg, Germany

[73] Assignee: MAN Roland Druckmaschinen AG, Offenbach A.M., Germany

[21] Appl. No.: 240,907

[22] Filed: May 11, 1994

[30] Foreign Application Priority Data

May 11, 1993 [DE] Germany ..... 43 15 595.2

[51] Int. Cl.[6] ..... B41F 31/06

[52] U.S. Cl. ..... 101/363

[58] Field of Search ..... 101/350, 363, 101/365, 366, 207, 208, 209, 210

[56] References Cited

U.S. PATENT DOCUMENTS

| | | | |
|---|---|---|---|
| 3,561,360 | 2/1971 | Branfield | 101/350 |
| 5,233,922 | 8/1993 | Stirbis | 101/363 |
| 5,273,582 | 12/1993 | Bernard | 101/363 X |
| 5,327,830 | 7/1994 | Gelinas et al. | 101/363 |

*Primary Examiner*—J. Reed Fisher

*Attorney, Agent, or Firm*—Cohen, Pontani, Lieberman, Pavane

[57] ABSTRACT

In order to provide good sealing for an ink fountain insert installed in a wedge-shaped ink fountain, the base of the insert is lengthened at its lower end by a resilient strip by which the insert can be arranged on the ink blade, and the side walls of the insert support a resilient wedge in the deflecting area of the strip.

16 Claims, 3 Drawing Sheets

INSERT FOR INK FOUNTAINS FOR PRINTING MACHINES

BACKGROUND OF THE INVENTION

1. Field of the Invention

The invention is directed to an insert for ink ducts or ink fountains for printing machines, and more specifically for wedge-shaped undershot ink fountains.

2. Description of the Prior Art

Inserts for ink fountains in printing machines that enable rapid changing of the printing ink are known, for example from EP 00 22 912 B1. This insert is inserted in the ink fountain of the printing machine so that its base rests on the ink blade of the ink fountain. During printing operation, it is disadvantageous to have printing ink penetrate between the ink blade and the base of the insert and flow under the insert. On the one hand, this presents a time-consuming cleaning problem when changing ink. On the other hand, hydrodynamic forces occur which can lift up the ink fountain insert.

SUMMARY OF THE INVENTION

Accordingly, it is an object of the present invention to provide an ink fountain insert which can be inserted into the ink fountain and specifically in an undershot ink fountain so as to provide good sealing.

Pursuant to this object, and others which will become apparent hereafter, one aspect of the present invention resides in an insert having a base, side walls and a resilient strip that extends from the lower end of the base for placing the insert on the ink blade of a wedge-shaped ink fountain. The side walls support a resilient wedge in a deflecting area of the resilient strip. The elastic or resilient strip can adapt well to the deformation of the adjusted ink blade and accordingly reliably seals the latter relative to the insert. Thus, the ink fountain is protected against soiling and a good fit of the insert is ensured.

The various features of novelty which characterize the invention are pointed out with particularity in the claims annexed to and forming a part of the disclosure. For a better understanding of the invention, its operating advantages, and specific object attained by its use, reference should be had to the drawing and descriptive matter in which there are illustrated and described preferred embodiments of the invention.

DETAILED DESCRIPTION OF THE PREFERRED EMBODIMENTS

Figure 1:
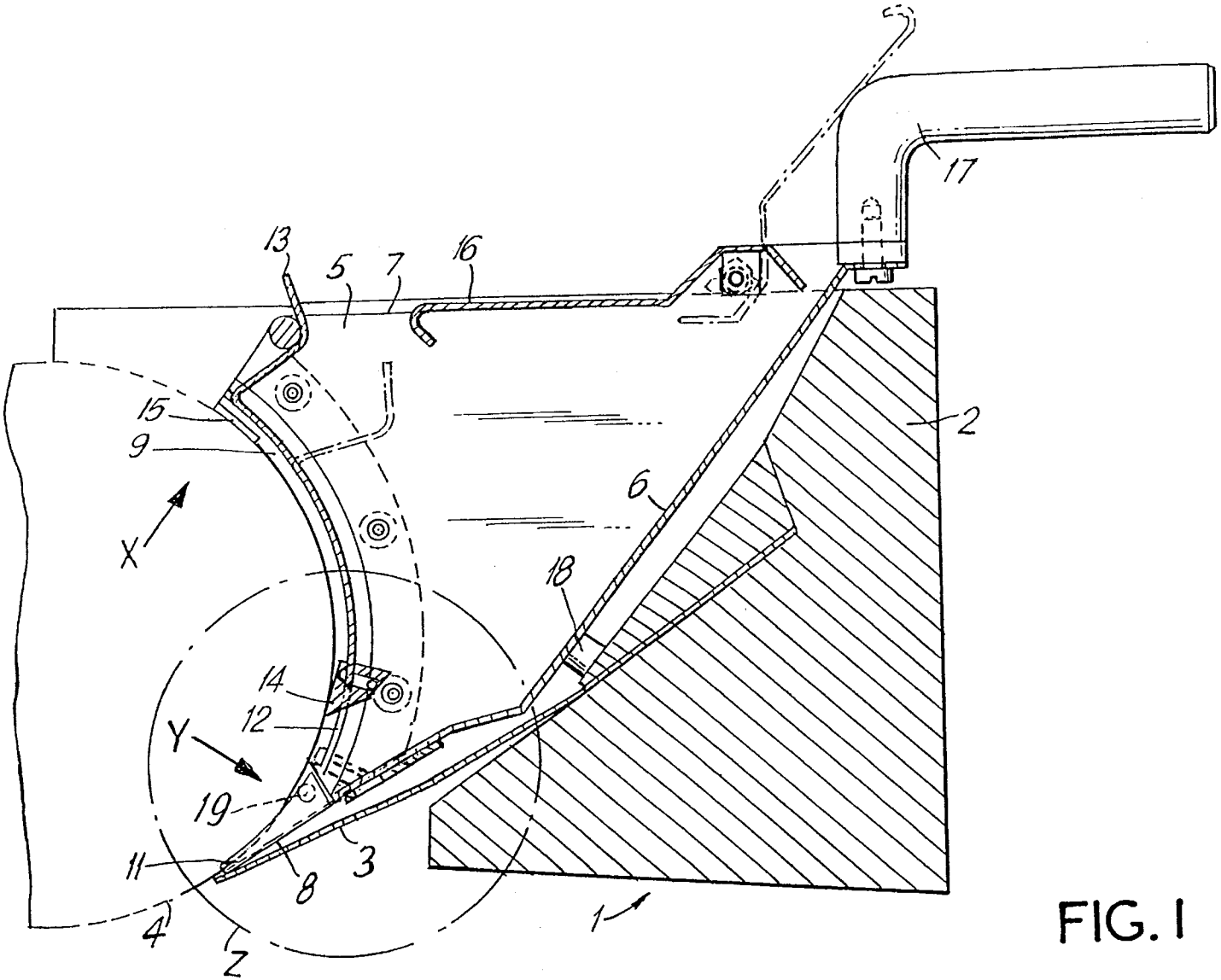
FIG. 1 shows an ink fountain insert pursuant to the present invention in cross section.
Figure 2:
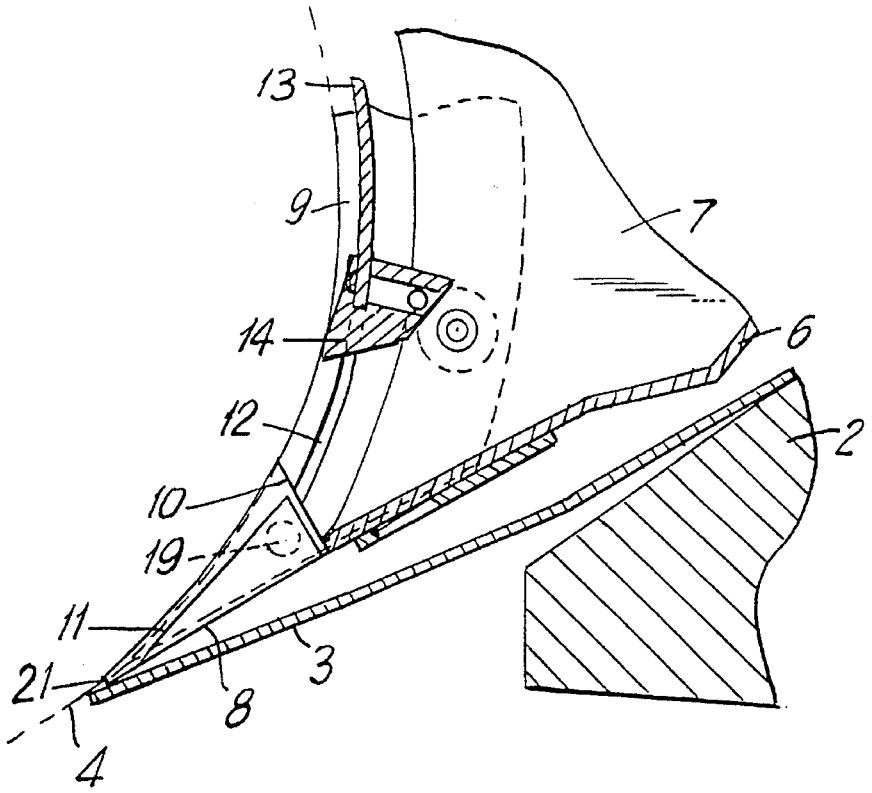
FIG. 2 is detail Z from FIG. 1.
Figure 3:
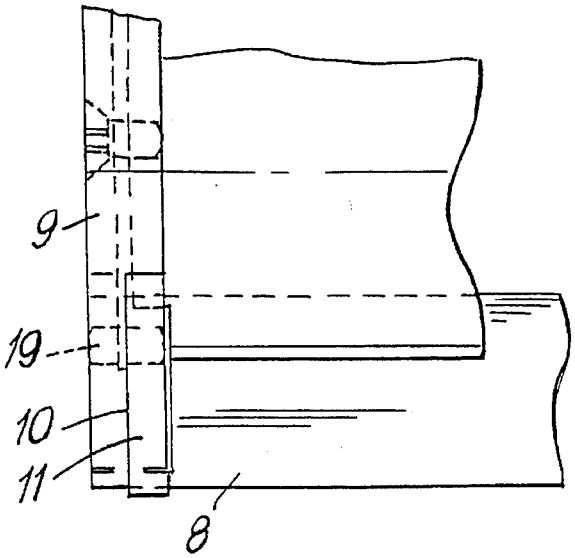
FIG. 3 is view Y from FIG. 1.
Figure 5:
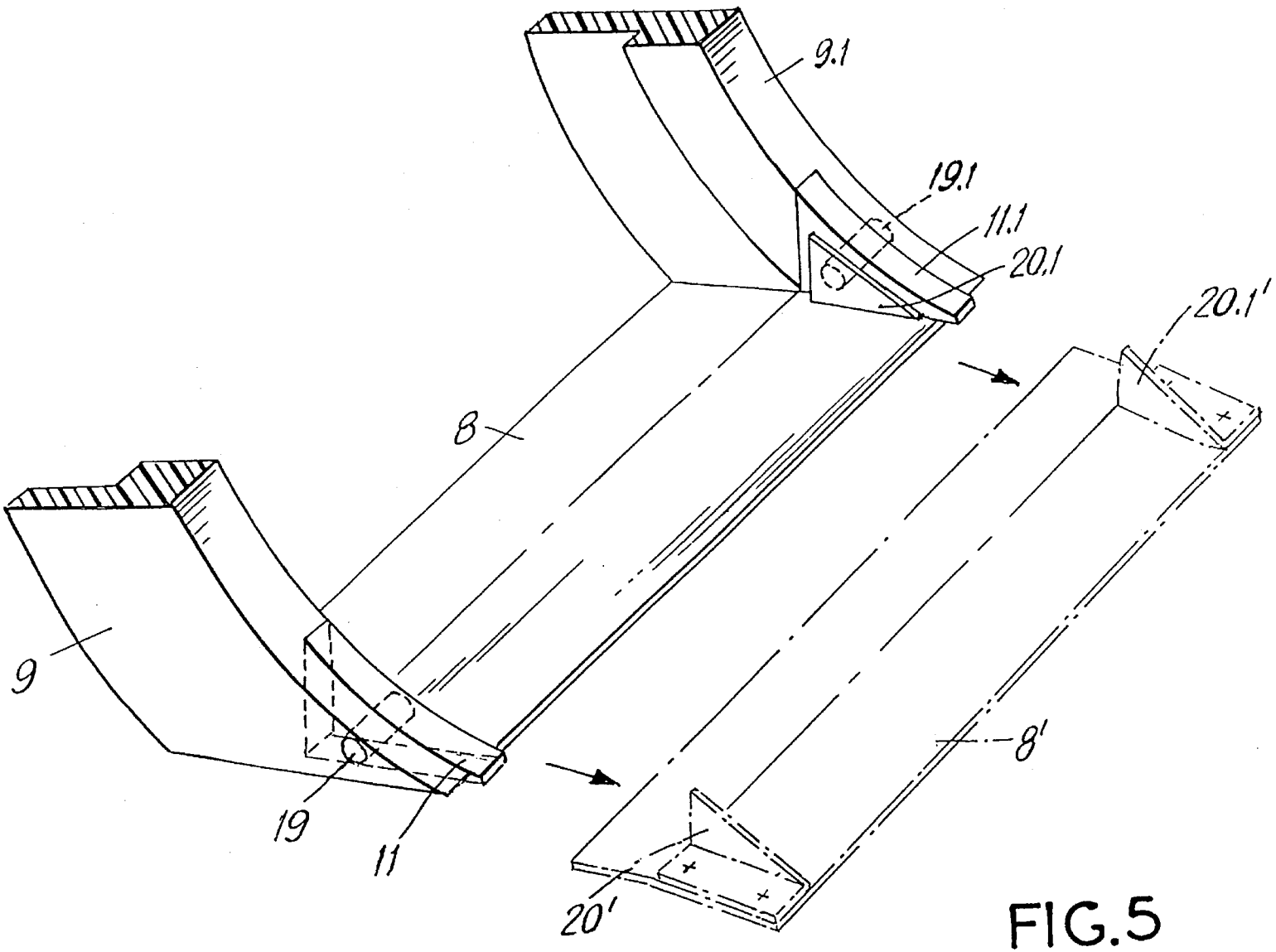
FIG. 5 shows the sealing elements of the insert in perspective.

The wedge-shaped ink fountain 1 shown in FIG. 1 contains an ink blade 3 which is fastened to a blade rail 2 and cooperates with an ink fountain roller 4. An insert 5 is inserted in the ink fountain 1 and has a housing formed by a base 6 and two side walls 7. The base 6 is lengthened at its lower end by a resilient strip 8. In the embodiment shown, the strip 8 is made of spring steel with a thickness of approximately 0.3 mm. However, a resilient plastic strip, for example, could also be used. The strip 8 is inserted into a slot at the underside of the base 6 (FIG. 2). A plastic segment 9, 9.1, whose curvature corresponds to the radius of the ink fountain roller 4 and by which the insert 5 contacts the latter, is screwed to each side wall. In the region of the entry wedge enclosed by the strip 8 and the ink fountain roller 4, each plastic segment 9, 9.1 has a cut out portion 10 (FIG. 3) in which a resilient wedge 11, 11.1 is inserted. This wedge 11, 11.1 is advantageously secured by means of a pin 19, 19.1 driven into the plastic segment 9, 9.1. Angles 20, 20.1 fastened on the strip 8 secure the wedges 11, 11.1 against lateral slippage (FIG. 5). An appropriate work material for the wedges 11, 11.1 is resilient plastic, e.g. polyurethane foam or an oil-resistant foam rubber. The wedges 11, 11.1 are provided to be easily accessible. The strip 8 which is secured in its slot in a frictional engagement or positive engagement in the illustrated embodiment need only be removed from the base 6 for this purpose.

Figure 4:
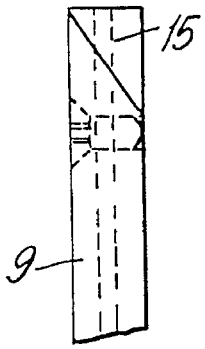
FIG. 4 is view X according to FIG. 1.

A groove 12 is incorporated in each plastic segment 9, 9.1 concentrically to the ink fountain roller 4 and a slide 13 runs in this groove 12. The slide supports a closing strip 14 at its lower end. At their upper end, the plastic segments 9, 9.1 have a notch 15 which opens toward the interior of the insert 5 (FIG. 4). The insert 5 is also outfitted with a cover 16 and a handle 17.

The insert 5 is inserted into the ink fountain, preferably, into an undershot ink fountain of a printing machine. It contacts the ink fountain roller 4 in a sealing manner with the plastic segments 9, 9.1. Further, it is supported in a punctiform manner at the blade rail 2 by means of a stub 18 arranged at its base. A stable support of the insert 5 in the ink fountain 1 is achieved by this quasi three-point support. Tests have determined the optimal position of the stub 18 in which the insert 5 sits in a stable manner without requiring fasteners in the ink fountain 1 and in which the plastic segments 9, 9.1 are only subject to slight frictional wear. If the arrangement of the stub 18 is too high at the base of the insert 5, the inherent weight of the insert 5 does not exert an adequate counterforce opposing the hydrodynamic forces acting in the entry gap or feed gap of the ink fountain roller 4 and the insert 5 is forced away from the feed gap. If the stub 18 is arranged too low at the base 6, an increased area pressure is caused between the plastic segments 9, 9.1 and the ink fountain roller 4 resulting in substantial wear. Further, the stub 18 is centrically arranged between the side walls 7. Due to the absence of fasteners, the insert can be changed quickly and simply without tools.

When the insert 5 is inserted in the ink fountain 1, its strip 8 contacts the ink blade 3. A beveling of the strip 8 by approximately 5° away from the base 6 of the insert 5 provides for a resilient adaptation. The insert 5 occupies a position of equilibrium in a floating manner. Due to its elasticity which is achieved by an appropriate choice of work material and thickness, the strip 8 adapts to the deformation of the ink blade 3 depending on its adjustment and ensures tightness in this location. In the edge area, the resilient strip 8 can move into the region of the resilient wedges 11, 11.1 as the case may be. Moreover, the wedges 11, 11.1 provide for a good lateral sealing of the insert 5 up to the tip of the feed gap. For this purpose, the wedges 11, 11.1 are constructed so as to be overdimensioned toward the ink fountain roller 4. Furthermore, the wedges 11, 11.1 may be self-adjusting due to the degree of freedom of rotation with reference to the pins 19, 19.1. The wedges 11, 11.1 are dimensioned so that they do not extend to the end of the ink blade so as not to influence the proportioning of the ink. The exposed small wedge 21 (FIG. 2) does not bring about leakage of the insert 5. Moreover, ink which may possibly penetrate between the plastic segments 9, 9.1 and the ink fountain roller 4 is wiped away toward the interior of the insert 5 by the notch 15 during the rotation of the ink fountain roller 4.

The slide 13 serves to close the insert 5. This is the case in the position of the slide 13 shown in dashed lines, in which position the closing strip 14 of the slide 13 sits on the base 6 of the insert 5. Further, the closing strip 14 is only at a slight distance from the ink fountain roller 4 (preferably 0.5 to 1.0 mm) so that the closing strip acts as a distance seal and prevents the ink from rising between the ink fountain roller 4 and the slide 13.

The invention was described with reference to a preferred embodiment of a wedge-shaped, undershot ink fountain having only one ink blade located at the bottom and forming the ink fountain with the ink fountain roller. The invention is also applicable in ink fountains which have an ink blade at the top, so-called overshot fountains. The insert according to the invention can advantageously be constructed so as to be wide on one side and may be used, for example, in inking mechanisms for printing additional colors. The additional ink can then be changed very quickly and simply by changing the insert. However, the insert can also be constructed so as to be wider.

The three-point support of the insert 5 can be employed in the preceding embodiment in a particularly advantageous manner. However, it lies within the scope of the technical teaching to use the three-point support in other constructions of the insert, particularly in connection with other types of lateral seals.

The invention is not limited by the embodiments described above which are presented as examples only but can be modified in various ways within the scope of protection defined by the appended patent claims.

We claim:

1. An insert for an ink fountain of a printing machine, which ink fountain includes an ink blade, a blade rail and an ink fountain roller, the insert comprising: a base having a lower end; side walls each having a forward end shaped to compliment the ink fountain roller; a resilient strip that extends from the lower end of the base so as to facilitate placement of the insert on the ink blade of the ink fountain, and so that a portion of the strip can deflect; a resilient wedge supported by the side walls at the deflectable portion of the strip; and, a stub mounted on the base, whereby the insert is supportable in a three-point manner by the forward ends of the side walls at the ink fountain roller and by the stub at the blade rail.

2. An insert according to claim 1, wherein the wedge is made of polyurethane foam.

3. An insert according to claim 1, wherein the strip is made of spring steel.

4. An insert according to claim 1, wherein the strip is made of plastic.

5. An insert according to claim 1, wherein the strip has a thickness dimensioned so that the strip is adaptable to deformations of the ink blade.

6. An insert according to claim 1, wherein the strip is arranged and adapted so that in an unloaded state the strip is angled at approximately 5° away from the base.

7. An insert according to claim 1, wherein the wedge is dimensioned so as to extend out from the resilient strip.

8. An insert according to claim 1, wherein the wedge has a tip arranged and adapted to be at a distance from a tip of the ink blade when the insert is installed in the ink fountain.

9. An insert according to claim 1, and further comprising a slide adapted to be guided in the side walls.

10. An insert according to claim 9, and further comprising a closing strip supported at a lower end of the slide so that the closing strip is at a slight distance from the ink fountain when the insert is installed in the ink fountain.

11. An insert according to claim 1, adapted to be insertable into a wedge-shaped ink fountain.

12. An insert according to claim 1, adapted to be insertable into an undershot ink fountain.

13. An insert for an ink fountain of a printing machine, the insert comprising: a base having a lower end; side walls; a resilient strip that extends from the lower end of the base so that a portion of the strip can deflect; a resilient wedge supported by the side walls at the deflectable portion of the strip; and a stub mounted on the base whereby the side walls and stub provide a three-point mounting for the insert.

14. A combination comprising:

an ink fountain having a roller, a blade rail adjacent to the roller, and an ink blade mounted to the blade rail so as to extend from the blade rail to the roller; and an insert for the ink fountain, the insert including a base having a lower end, side walls having front ends shaped to compliment the ink fountain roller, a resilient strip that extends from the lower end of the base so as to facilitate placement of the insert on the ink blade of the ink fountain, and so that a portion of the strip can deflect, a resilient wedge supported by the side walls at the deflectable portion of the strip, and a stub mounted on the base of the insert so that the insert is supported in a three-point manner by the front ends of the side walls against the ink fountain roller and by the stub against the blade rail.

15. A combination as defined in claim 14, wherein the ink fountain is wedge-shaped.

16. A combination as defined in claim 14, wherein the ink fountain is an undershot ink fountain.

* * * * *